US010283023B1

(12) United States Patent
Bernstein et al.

(10) Patent No.: US 10,283,023 B1
(45) Date of Patent: May 7, 2019

(54) 3D SHELF TALKER

(71) Applicant: Robert Bernstein, White Plains, NY (US)

(72) Inventors: Robert Bernstein, White Plains, NY (US); John Greer, Harrison, NY (US)

( * ) Notice: Subject to any disclaimer, the term of this patent is extended or adjusted under 35 U.S.C. 154(b) by 0 days.

(21) Appl. No.: 15/949,835

(22) Filed: Apr. 10, 2018

Related U.S. Application Data

(60) Provisional application No. 62/501,409, filed on May 4, 2017, provisional application No. 62/484,124, filed on Apr. 11, 2017.

(51) Int. Cl.
*G09F 23/06* (2006.01)
*G09F 7/18* (2006.01)

(52) U.S. Cl.
CPC ..... *G09F 23/06* (2013.01); *G09F 7/18* (2013.01); *G09F 2007/1856* (2013.01)

(58) Field of Classification Search
CPC ..... G09F 23/06; G09F 7/18; G09F 2007/1856
See application file for complete search history.

(56) References Cited

U.S. PATENT DOCUMENTS 2,984,031 A * 5/1961 Giesecke ..... G09F 3/204 40/649
3,977,109 A * 8/1976 Berry, Jr. ..... F24H 1/40 40/124.05
5,848,698 A * 12/1998 Stompe ..... A47F 5/0068 206/449
7,055,274 B2 * 6/2006 Fast ..... G09F 3/204 248/220.41
2009/0220651 A1 * 9/2009 Buxton ..... A23C 19/00 426/87
2011/0214325 A1 * 9/2011 Darress ..... G09F 3/08 40/661.03
2011/0239501 A1 * 10/2011 Ricci ..... G09F 3/204 40/541
2013/0074386 A1 * 3/2013 Santarelli ..... G09F 23/06 40/606.01
2017/0116892 A1 * 4/2017 Garfinkle ..... G09F 3/204
2017/0249876 A1 * 8/2017 Emoff ..... G09F 7/18
2017/0278435 A1 * 9/2017 Shea ..... G09F 23/06

* cited by examiner

*Primary Examiner* — Gary C Hoge
(74) *Attorney, Agent, or Firm* — Mandelbaum Silfin Economou LLP

(57) ABSTRACT

A 3D shelf talker in the form of a planar substrate has a profile and scored fold lines defining three advertising panels for displaying text and/or graphics identified with a product, and at least one fastener panel integral with one of the advertising panels and adherable to another of the panels for stabilizing the shelf talker once erected into a hollow rectangular parallelepiped. The fastener panel may be provided with a connector for mounting the shelf talker on a shelf fixture in an aisle of a store where one of the advertising panels is visible for indicating the location of the product to a customer along either end of the aisle or directly opposite the product.

28 Claims, 17 Drawing Sheets

3D SHELF TALKER

BACKGROUND OF THE INVENTION

Three-dimensional aisle signs, known as 3D shelf talkers or aisle violators, for advertising a product on a shelf in an aisle of a store and indicating its location, mounted on shelves in a store aisle, are known, but until the present invention, none has incorporated three identical profiles of a product or its container in the general shape of a rectangular parallelepiped so that shoppers in the store can see the profiles from three different directions, i.e., looking up or down the aisle from either side of the product or facing from directly opposite the product.

U.S. Patent Application Publication No. 2011/0214325 by Darress for a Multi-Dimensional Shelf Label concerns a multidimensional shelf label formed from a flat piece of paper. Although Darress's label faces up and down an aisle as well as across the aisle. However, Darress employs tabs which extend from both sides of the sign and which are visible when the label is installed. Moreover, Darress's label lacks the rigidity provided by the proposed invention.

U.S. Pat. No. 3,711,977 to Blankenhorn for a Dimensional Display Flagger discloses a normally flat-lying display body with oppositely extending supporting arms between which there is a label portion. The arms fit within the channels between shelves. When the arms are pushed toward one another, the label portion buckles outwardly and assumes a rounded 3D shape. Blankenhorn discloses that the display body may be of a particular shape associated with a product, e.g., having the form of a bottle associated with a certain type or brand of goods.

Several prior art patent device employ tabs extending outwardly from a central display medium convertible from two dimensional to three dimensional by moving the tabs toward one another.

U.S. Pat. No. 2,984,031 to Giesecke for an Advertising Tag covers a shelf display formed from a planar substrate. When outward extending tabs are aligned for placement within the channel of a shelf, the central portion of the tag bulges outwardly forming a 3D shape which can be that of an advertised product. The name of the product can be imprinted on the tabs.

U.S. Pat. No. 4,161,074 to DePinna for a Three-Dimensional Product Marker is also about a 3D sign that is cut from a sheet material. Outwardly extending tabs, which can have advertising copy on them, are captured in a shelf channel. A center portion of the sign, which can extend between the tabs of the sign is cut so that the tabs can be pushed together forcing the portion to assume a cylindrical shape.

U.S. Pat. No. 4,471,544 to Nelles, et al. for a Three Dimensional Information Transmitting Device also discloses a sign formed by bending along fold lines and using interlocking slits to maintain a 3D disposition. Outwardly extending tabs or wings are mountable within a shelf channel.

U.S. Pat. No. 6,360,465 to Simpson for a Collapsible Shelf Sign teaches the construction of a collapsible shelf sign with a shelf clip for mounting to a channel of a shelf. The sign has a triangular shape with one side parallel to and against the channel and the other two sides facing diagonally outward. Each of the outward facing sides can be viewed from a respective end of an aisle and both can be seen from a position opposite the sign. However, the signs are presented at an angle and viewing is not head on as in the case of the proposed invention.

U.S. Pat. No. 4,384,418 to Alley for Elastic Action Shelf Display deals with a shelf display which is vertically mounted between upper and lower shelves. The display, which is in the form of a 2-dimensional card can have the shape of a product, e.g., a bottle. The display is mounted with an elastic cord so that a breeze caused by a shopper walking past the display causes it to rotate back and forth.

U.S. Pat. No. 3,706,150 to Greenberger for a Three-Dimensional Molding Sign and Method of Fabricating Same describes a three-dimensional molding sign formed out of sheet material. The sign is mounted on an arm which extends from an anchor for attachment to a shelf.

U.S. Pat. No. 6,167,644 to Fox for an Advertising Display Standard explains the construction of a stand on which advertising material can be mounted and transformed from two-dimensional to three-dimensional by inserting tabs on the advertising material into slots on the display standard.

U.S. Patent Application Publication No. 20090064547 by Condor for a Snap mobile for Advertising a Product or Event seeks patent protection for an advertising mobile formed from a sheet material with multiple parallel score lines. The sheet material is folded at the score lines and selected panels are fastened together to form three dimensional shapes. The mobile is adapted to be hung and does not have attachment tabs or other means for mounting in a shelf channel.

None of the aforementioned signs provides three orthogonal views of an advertisement while mounted on in a shelf channel with the mounting device concealed by the sign while maintaining the rigidity provided by the present invention.

The aisle sign of the invention can be shipped flat and consolidated in the same box with other store signage materials, this saves on shipping material costs and reduces the time needed for merchandising installer to complete their work in store. The invention allows an aisle sign to be quickly and simply opened by applying pressure at scores along which the panels of the planar substrate are foldable. This feature reduces the installation time and increases the productivity of the merchandiser installer.

The aisle sign can be universally applied in virtually any store at different point of sale venues. It can be applied on a shelf, affixed to a freezer cooler door or an end aisle display.

SUMMARY OF THE INVENTION

A three-dimensional display for a product or its container is prepared by printing on panels having a profile symmetrical to the product or container face, side-by-side on a flat cardboard or similar substrate, three identical 2-dimensional images of the face of the product container. The images cut from the substrate are left connected near their centers. Also, cut with the images, at one side, is an extension which is scored to define two or more support panels. The support panels eliminate the need for secondary fixtures required to prevent the aisle sign from collapsing at a point of sale.

In a preferred embodiment of the invention, four support panels form a T extending laterally from one of the image panels. The horizontally extending leg of the T is covered with an adhesive which can be a pressure sensitive adhesive coated onto a double sided adhesive tape. Other forms of adhesive may be used as will be known to those skilled in the art. For example, the horizontally extending leg of the T 17 can have a dot of a water based or other adhesive on its surface or the surface may be otherwise coated partially or entirely with such an adhesive.

The planar cut-out can then be folded to form a generally rectangular parallelepiped with the adhesive surface tucked behind and fastened to the inner surface of the image panel most distant from the T-shaped extension. The left and right support panels of the T are folded inwardly to stabilize the structure and prevent it from collapsing. The adhesive coated panel is also folded inwardly to cover the opening between the left and right support panels with its adhesive surface facing outwardly. The rear surface of the most distant image panel is adhered to the adhesive coated panel.

A channel mount anchor, i.e., a channel clip, is fastened, e.g., glued, to the outside of the support panel at the center of the T. The channel mount projection fits into a standard channel that runs along shelves in supermarkets, drug stores and the like. The 3D display can be seen from either end of an aisle in which the display is mounted and, also, from a position opposite the front of display.

DESCRIPTION OF THE PREFERRED EMBODIMENTS

The present invention is a shelf talker in the form of a three-dimensional aisle sign or display for illustrating a product or its container for viewing from all directions within a store aisle. The shelf talker is intended to be mounted on the edge of a store shelf, e.g. in a supermarket, drugstore or the like, next to products on the shelf which are to be advertised to customers in the aisle of a store and help them to locate the advertised products.

The shelf talker of the invention, when assembled, has three orthogonal two-dimensional image panel panels, two of which face opposite ends of an aisle and one facing in a direction transverse to the aisle so that at least one of the image panel panels is visible at all times to a customer entering or having entered the aisle.

Figure 1:
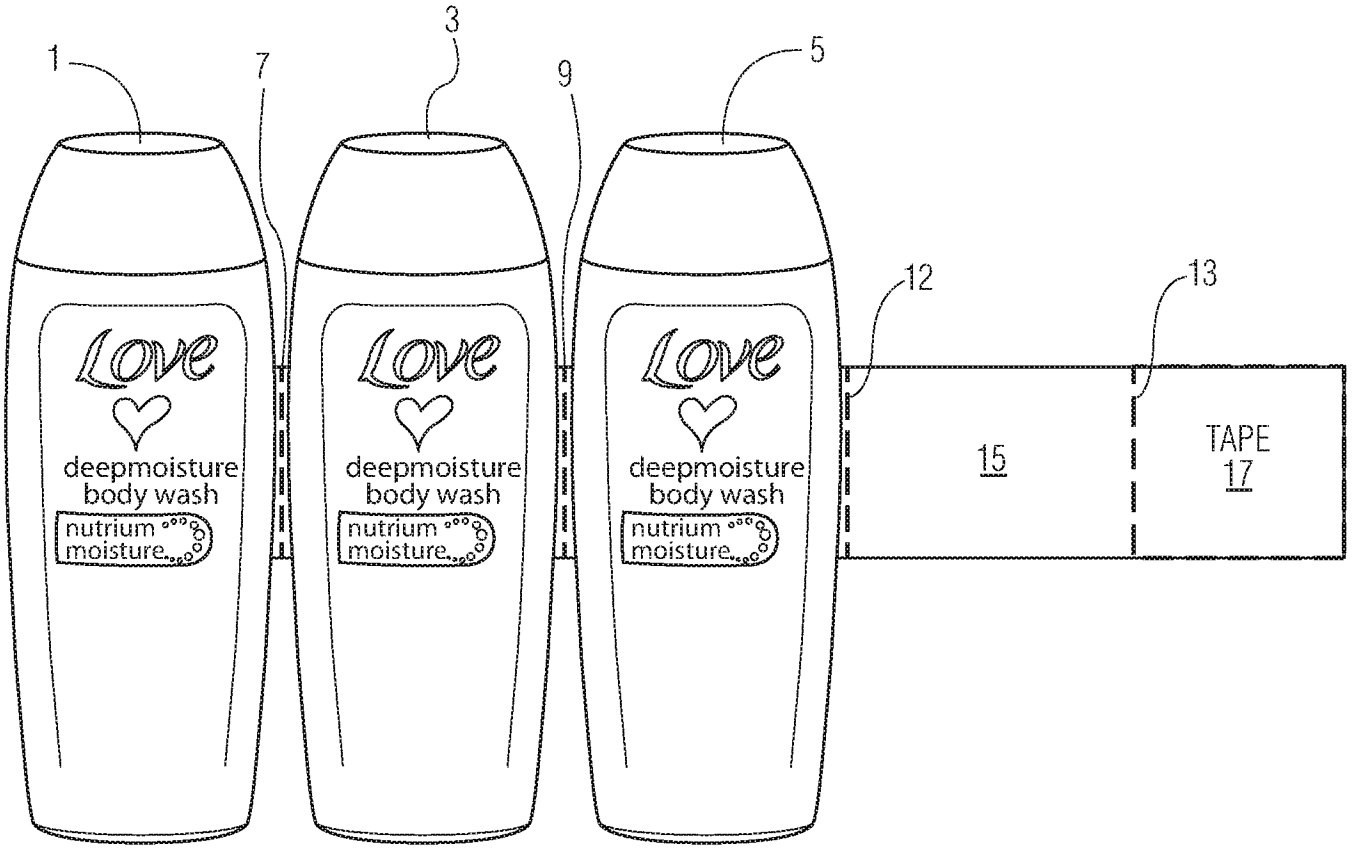
FIG. 1 is a front view of a first embodiment of the invention in a disassembled state.

In FIG. 1 of the drawings there is shown a first embodiment of the invention. Cut from a planar sheet material, preferably paper or plastic based, e.g., cardboard, in a single piece, are three identical, side by side, two dimensional panels 1, 3, 5 each of which has a top free edge and a bottom free edge, and on each of which there is printed an image of the face of a product with descriptive text. The image panels 1, 3, 5 are joined at their maximum widths, which are equal in the embodiment shown in the drawings, by integral narrow strips 7 and 9 which are centrally scored in a direction parallel to the vertical axes of the images. As can also be seen in the drawings, the portion of each strip on each side of each score line forms a part of the adjacent panel. Strip 7 connects left image panel 1 to center image panel 3 and has a score line on an axis about which image panel 1 and image panel 3 are symmetric, and strip 9 connects center image panel 3 to right image panel 5 and has a score line on an axis about which image panel 3 and image panel 5 are symmetric, as can be seen in FIG. 1.

Projecting horizontally from the maximum width of image panel 5 is an extension panel which is scored along lines 12 and 13 in a direction transverse to the length of the extension panel and parallel to the score lines on connector strips 7 and 9.

The score line 13 divides the extension into panels 15 and 17. Panel 17 is covered with a pressure sensitive adhesive or a double sided adhesive tape. Alternatively, a single horizontal strip can be adhered to the rear surfaces of separate image panels 1, 3 and 5 to achieve a similar result.

Figure 2:
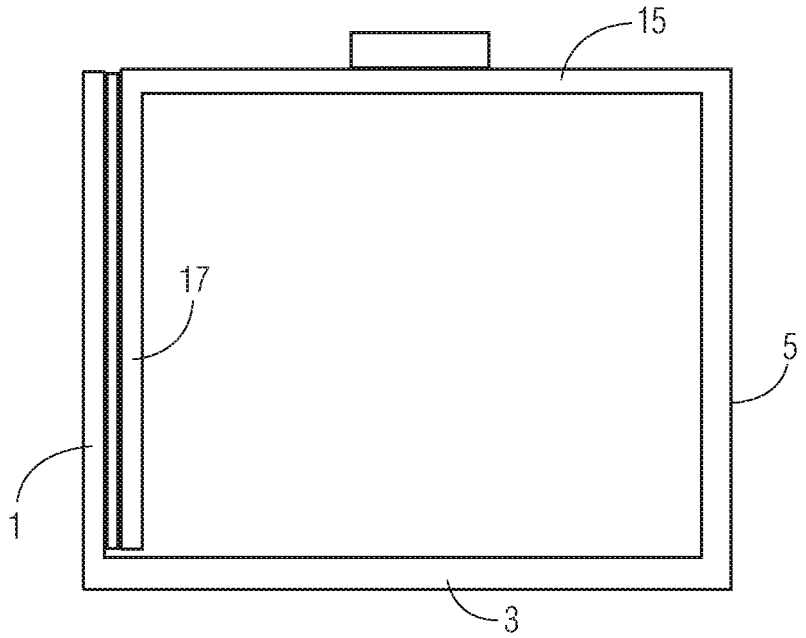
FIG. 2 is a top view of the first embodiment of the invention in an assembled state
Figure 3:
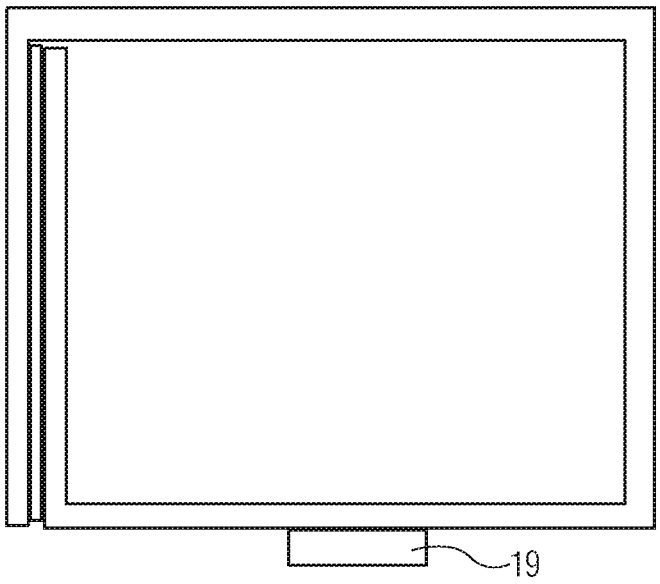
FIG. 3 is a bottom view of the first embodiment of the invention in an assembled state

Referring to FIGS. 2 and 3, in order to erect the 3D shelf talker for use, panels 1 and 5 can be folded rearwardly into parallel planes ninety degrees from the plane of image panel 3 to form the left and right side walls of the shelf talker display aisle sign, leaving central panel 3 facing forward.

In order to secure the three-dimensional display in position, panel 15 is folded rearwardly so that it lies in a plane spaced from and parallel to the plane of central image panel 3. Panel 17 is then folded ninety degrees about score line 13 so that it is parallel to the rear face of the image panel 1 with the adhesive surface of panel 17 facing the inner surface of panel 1. The adhesive surface of the panel 17 is then pressed onto the rear surface of image panel 1 thereby securing the three-dimensional display in the disposition of a rectangular parallelepiped with the top free edges of panels 1, 3, and 5 forming borders around an open space at the top end of the aisle sign and the bottom free edges of panels 1, 3, and 5 forming border, around an open space at the bottom end of the aisle sign. A shelf channel connector 19 is attached to the outside rear facing surface of panel 15 for use in affixing the aisle sign or display to a standard shelf channel.

Figure 1A:
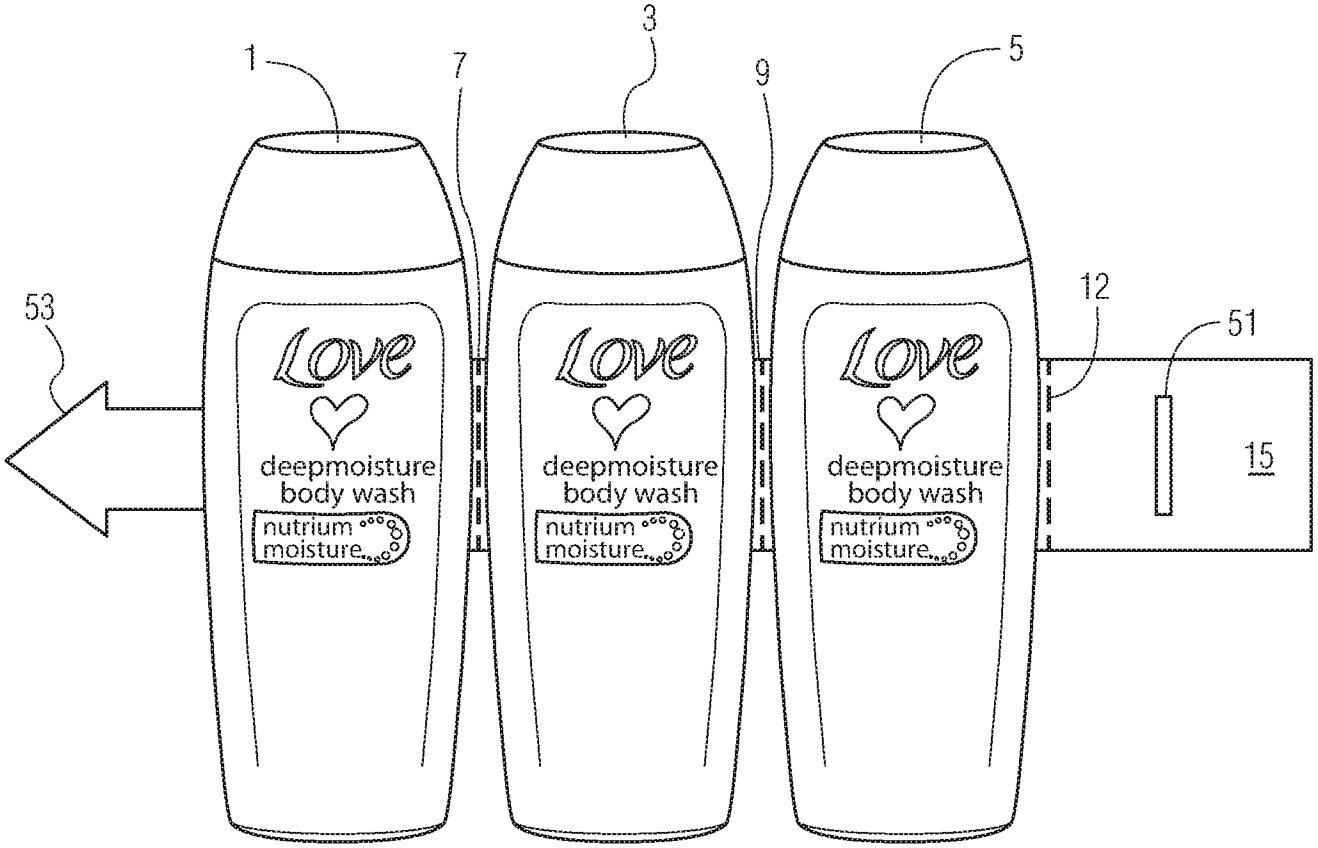
FIG. 1A is a front view of the first embodiment of the invention in a disassembled state with a modification.

Referring to FIG. 1A, adhesive panel 17 may be omitted and panel 15 may be provided with a narrow opening in the form of a slit 51 for receiving the barb of an arrow-shaped panel 53 extending from panel 1. When the display is assembled, the panel 15 is folded back so that it is in a plane parallel to the plane of panel 2, and panel 53 is folded back into the same plane as panel 15. The arrow head of panel 53 is inserted through the slit 51 and is captured therein by the barbs on panel 53. This configuration allows the display to be die cut from a sheet material in one piece and be ready for assembly. It will be appreciated that other interlocking configurations for the panels 15 and 53 are possible. For example, the edges of panels 15 and 53 and be slit, both horizontally, or both vertically and the respective panels 15 and 53 can then be interlocked.

Figure 4:
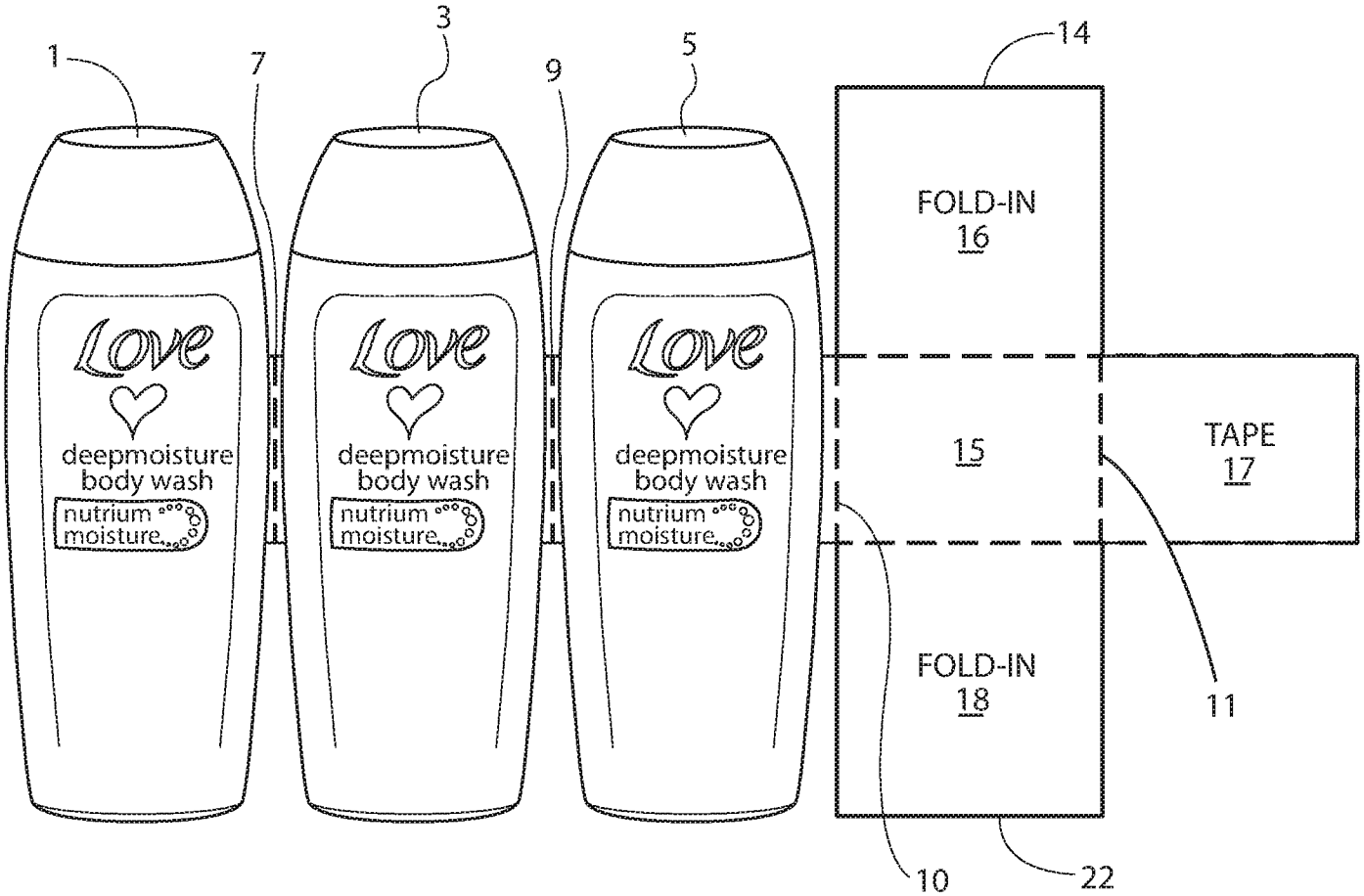
FIG. 4 is a front view of a second embodiment of the invention in a disassembled state.

Referring now to FIG. 4 of the drawings, there is shown a second embodiment of the invention which includes the structure of the first embodiment but to which additional panels are added to improve the structural integrity of the aisle sign or display.

Like numerals have been used to reference like elements in the first and second embodiments. The second embodiment is substantially identical to the first embodiment except for the addition of panels 16 and 18.

Figure 5:
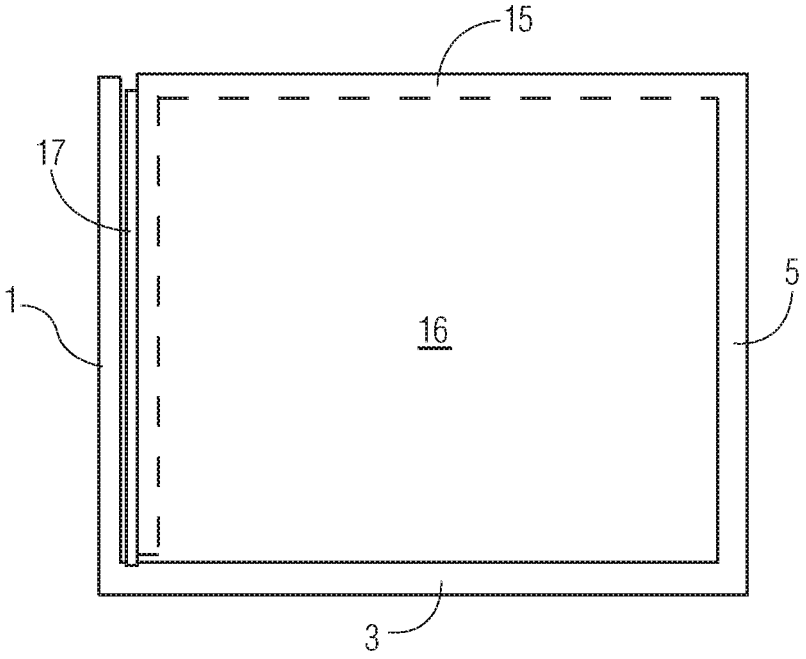
FIG. 5 is a top view of the second embodiment of the invention in an assembled state
Figure 6:
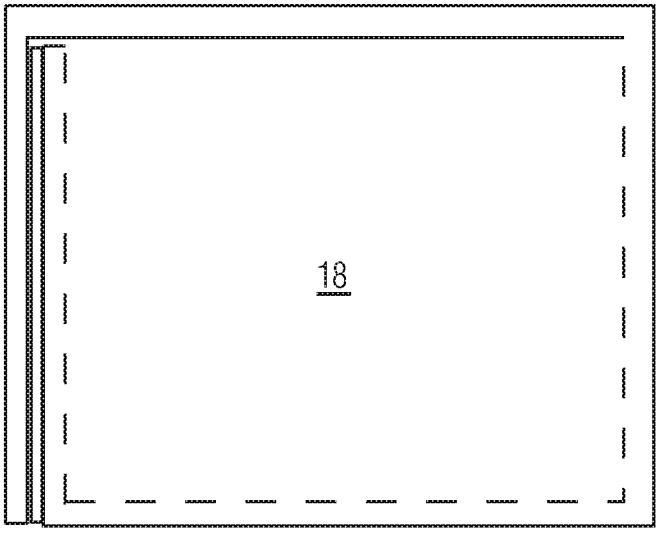
FIG. 6 is a bottom view of the second embodiment of the invention in an assembled state

As with the first embodiment, the display of the second embodiment is preferably die cut from a planar substrate of sheet material such as cardboard, plastic or the like. Connecting strips 7 and 9 are scored to facilitate folding of image panel panels 1 and 3 ninety degrees rearwardly from center image panel 3. Panel 15 is folded along score line 10 ninety degrees from image panel 5 to a position at which panel 15 is parallel to and spaced from the plane of image panel 3. Adhesive covered panel 17 is folded ninety degrees with respect to panel 15 to a position where the adhesive covered surface of panel 17 is parallel and closely adjacent to the rear (unprinted) surface of panel 1. Panels 1 and 17 are pressed together so that panel 17 is affixed to panel 1 as best seen in FIGS. 5 and 6.

In the second embodiment of the invention, panels 16 and 18 are also folded in toward one another, ninety degrees from panel 15 along score lines separating panels 16 and 18 from panel 15 so that a free edge 22 of panel 18 and a free edge 14 of panel 16 are brought into close proximity or engagement with the rear (unprinted) surface of center image panel 3. Panel 16 forms the upper panel or ceiling of the display supporting structure while panel 18 forms the floor or lower panel of the supporting structure.

Figure 7:
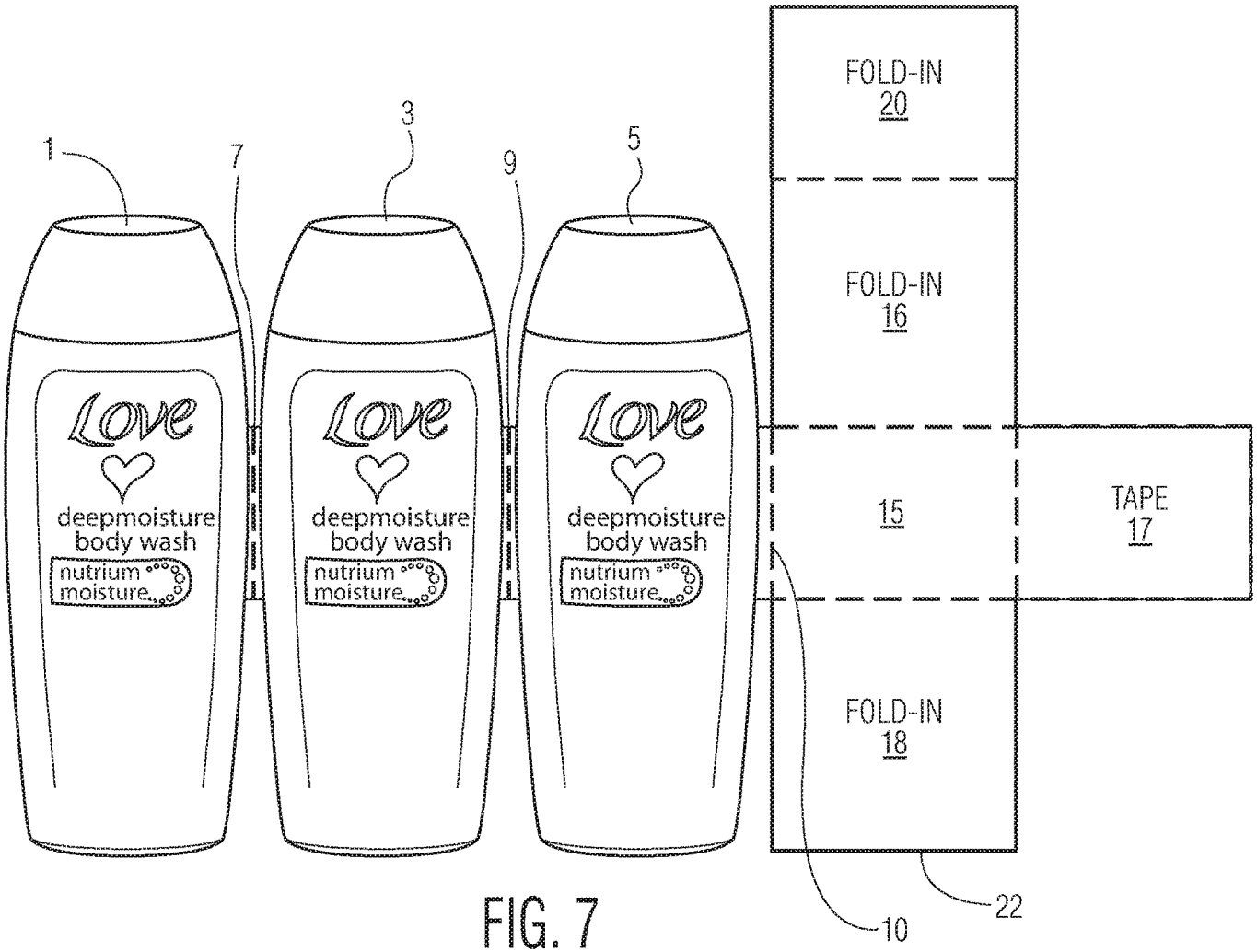
FIG. 7 is a front view of a third embodiment of the invention in a disassembled state.

Referring now to FIG. 7 of the drawings therein shown a third embodiment of the invention which includes the structure of the second embodiment but to which an additional panel 20 has been added to further enhance the structural integrity of the display.

Like numerals have been used to reference like elements in the description and drawings of the second and third embodiments of the invention. The third embodiment of the invention is substantially identical to the second embodiment except for the addition of panel 20.

Figure 8:
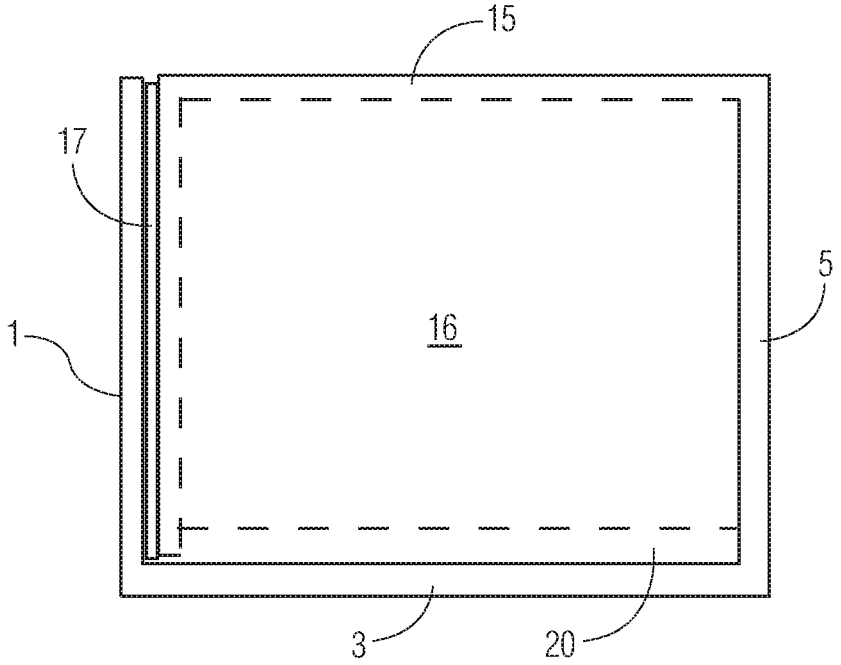
FIG. 8 is a top view of the third embodiment of the invention in an assembled state
Figure 9:
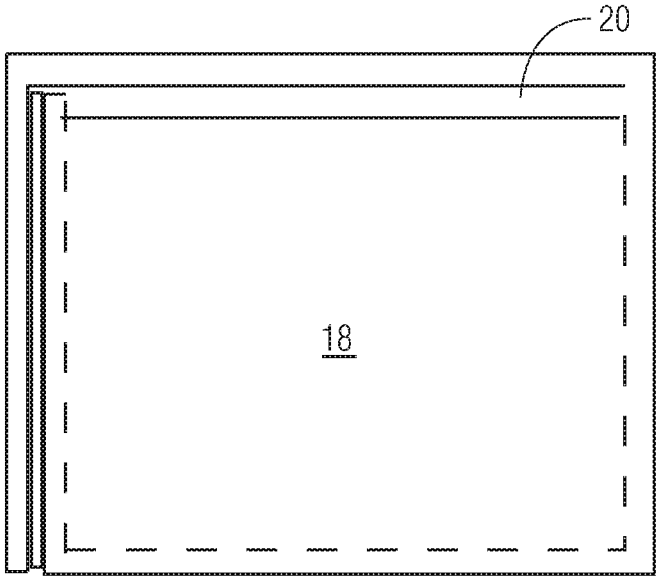
FIG. 9 is a bottom view of the third embodiment of the invention in an assembled state

As with the first and second embodiments, the display of the third embodiment is preferably die cut from a planar substrate of sheet material such as cardboard, plastic or the like. Connecting strips 7 and 9 are scored to facilitate folding of image panel panels 1 and 3 ninety degrees rearwardly from center image panel 3. Panel 15 is folded along score line 10 ninety degrees from image panel 5 to a position at which panel 15 is parallel to and spaced from the plane of image panel 3. Adhesive covered panel 17 is folded ninety degrees with respect to panel 15 to a position where the adhesive covered surface of panel 17 is parallel and closely adjacent to the rear (unprinted) surface of panel 1. Panels 1 and 17 are pressed together so that panel 17 is affixed to panel 1 as best seen in FIGS. 8 and 9.

In the third embodiment of the invention, panels 16 and 18 are also folded toward one another, ninety degrees from panel 15 along score lines separating panels 16 and 18 from panel 15 so that a free edge 22 of panel 18 and a score line between panels 16 and 20 are brought into close proximity or engagement with the rear (unprinted) surface of center image panel 3. Panel 16 forms the upper panel or ceiling of the display supporting structure while panel 18 forms the floor or lower panel of the supporting structure. Panel 20 is folded along the score line between panels 16 and 20 so that the front surface of panel 20, visible in FIG. 7 is in close proximity to or engagement with the rear (unprinted) surface of image panel 3. If desired, for further integrity, the adjacent surfaces of panels 3 and 20 may be glued or pasted together.

The panels 15, 16, 17, 18, 20 form, as a support structure, a hollow parallelepiped which is enclosed by the adjacent rear surface of image panel 5. The support structure strengthens and gives structural integrity to the display and resists external forces which, in its absence, could cause distortion or collapse, e.g., by being bumped by a store patron in the aisle.

Figure 10:
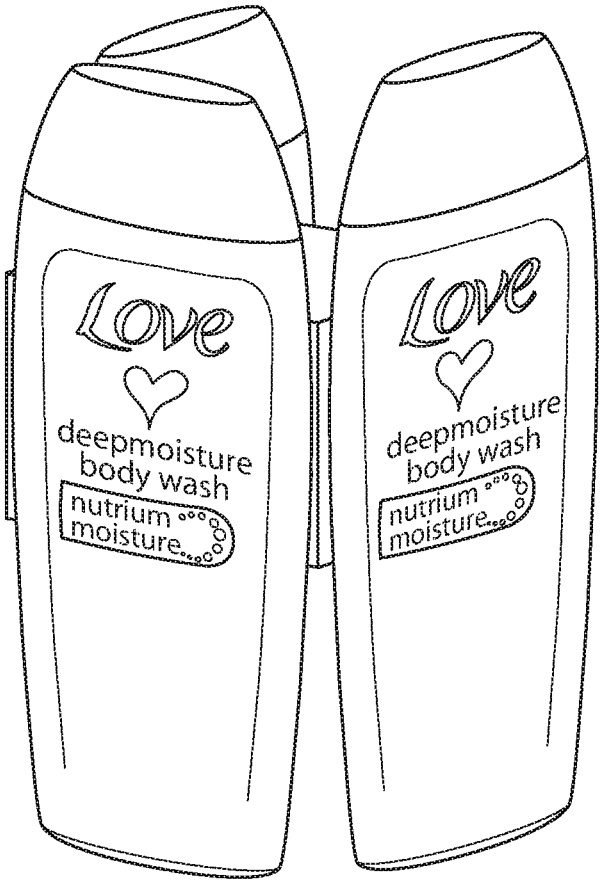
FIG. 10 is a front perspective view of the third embodiment of the invention in an assembled state
Figure 11:
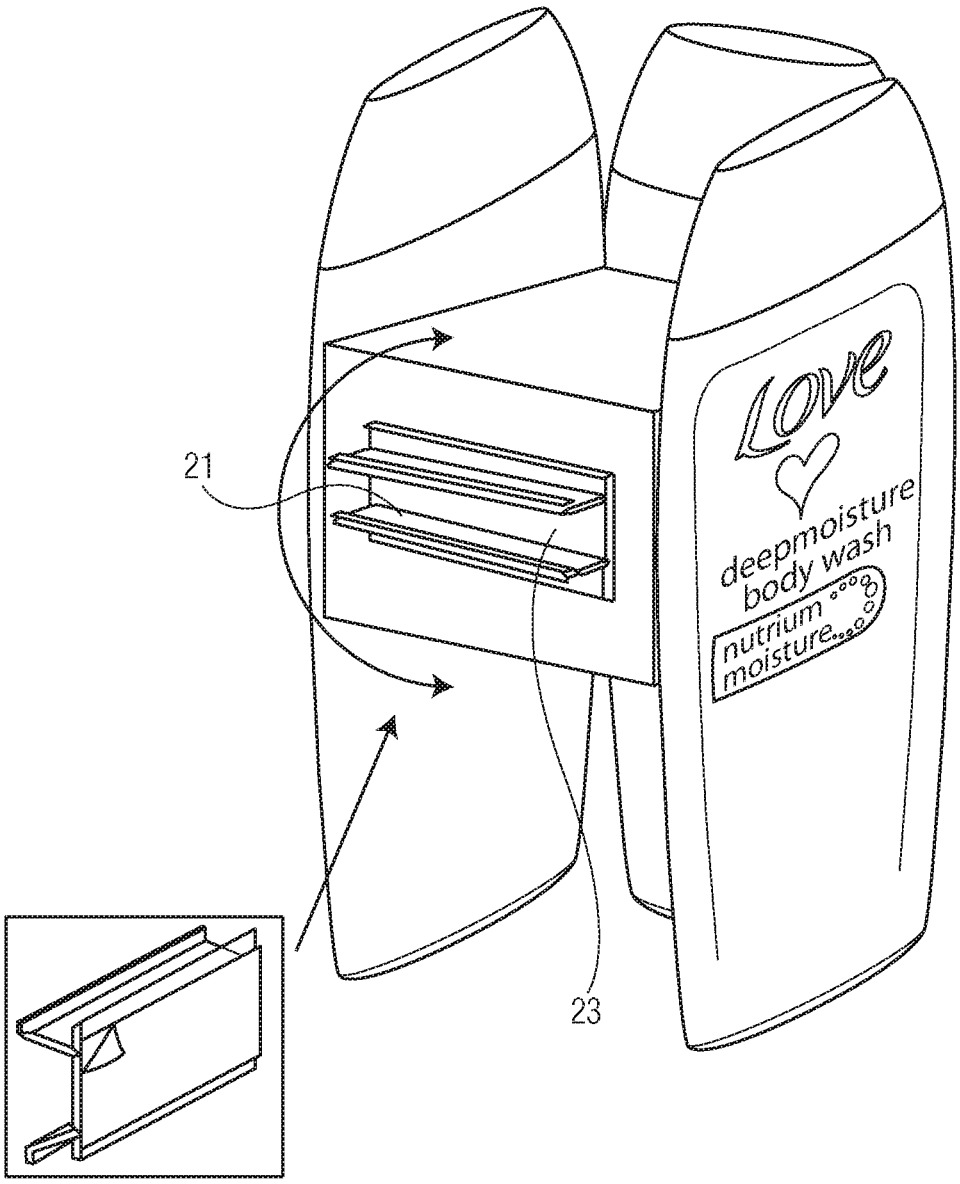
FIG. 11 is a rear perspective view of the third embodiment of the invention in an assembled state with an additional feature.

FIGS. 10 and 11, respectively, show a front prospective view and a rear perspective view of the third embodiment of the invention. Attached to the rear panel 15 is a shelf connector in the form of a channel clip 21 having a vertical planar surface 23 which is affixed to the outer surface of panel 15, e.g., by an adhesive. Projecting from the channel clip 21 are two spaced horizontal planar members each having a lip on its outer surface for being resiliently snapped into a standard shelf channel. The adhesive surface of the channel clip can be covered with a removable liner until ready for use. The liner is peeled away before attachment of the clip to the rear facing surface of panel 15.

Referring now to FIGS. 12-16 of the drawings there are shown several versions of integral substitutes for the channel clip 21 shown in FIG. 11.

Figure 12:
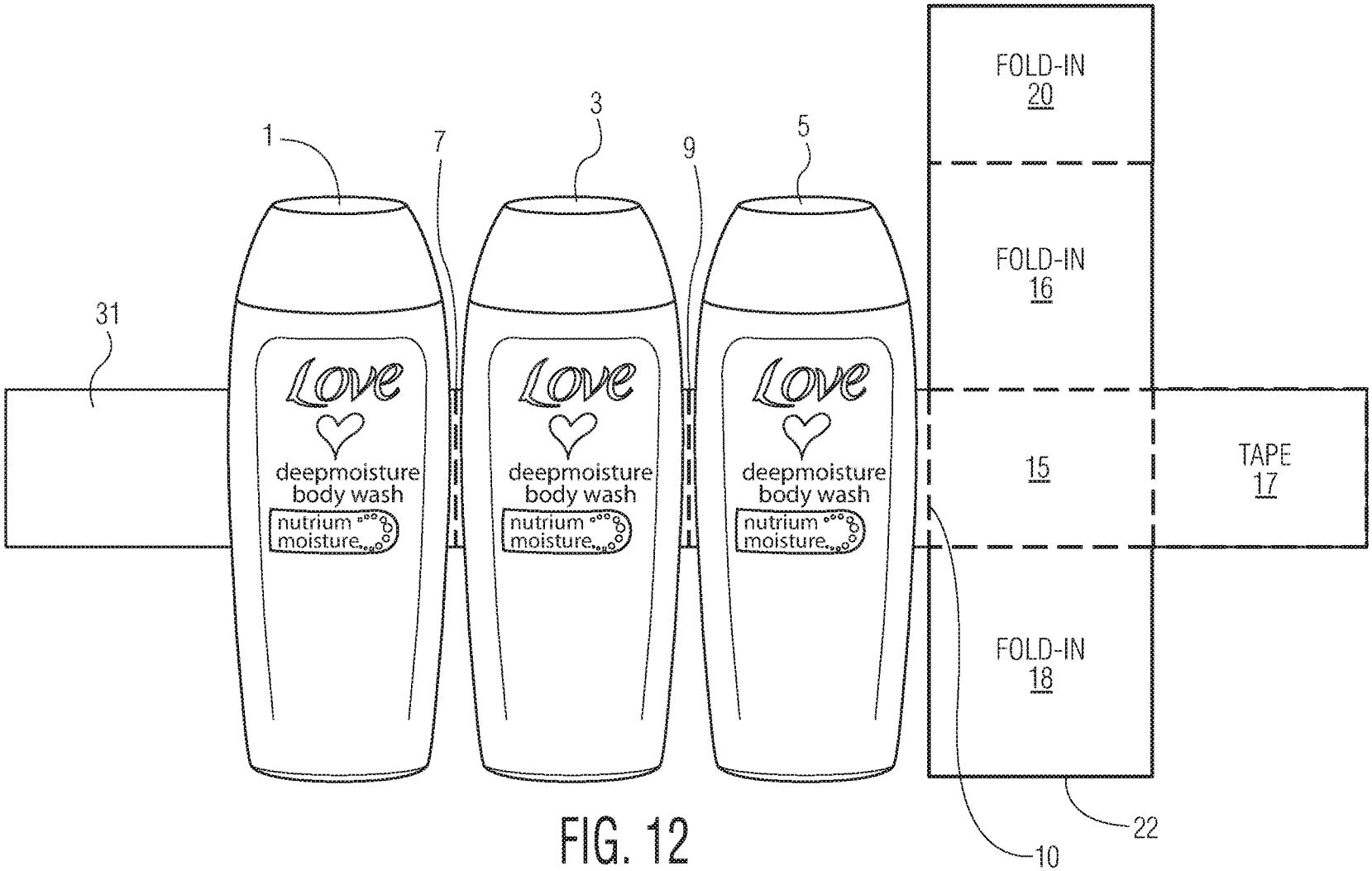
FIG. 12 is a front view of a fourth embodiment of the invention in a disassembled state.

As can be seen in FIG. 12 a panel 31 extends horizontally from and is integral with panel 1. Panel 31 is die cut with the panels, and is an integral part of, the display. Panel 31 provides an alternative to channel clip 21 for mounting the display on a shelf. Panel 31 may be used in one of three dispositions as explained below.

Figure 13:
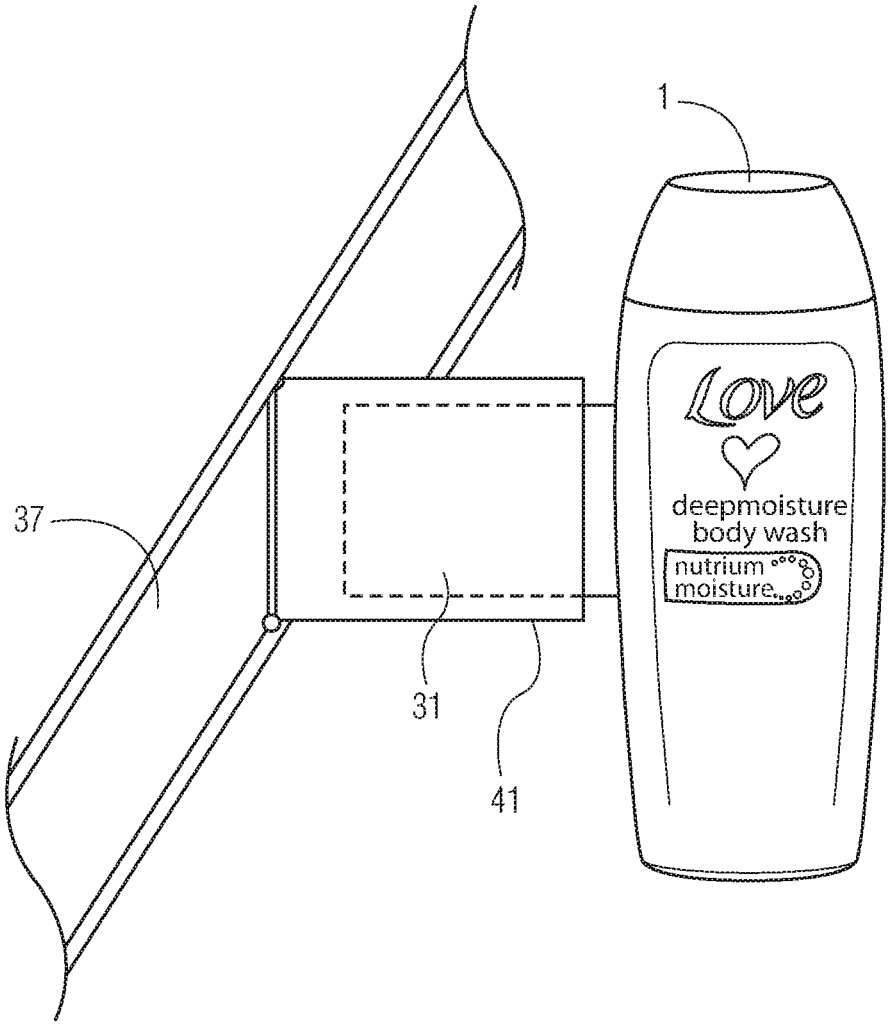
FIG. 13 is schematic environmental view of the fourth embodiment of the invention in one disposition.

Referring to FIG. 13 there is shown a view of the display from the left side with the panel 31 extending rearwardly and being in the same plane as left panel 1. In this disposition the panel 31 can be inserted directly into the slot of a shelf fixture 41. Thus in FIG. 13 the panel 31 is in the same position relative to panel 1 as show in FIG. 12.

Figure 14:
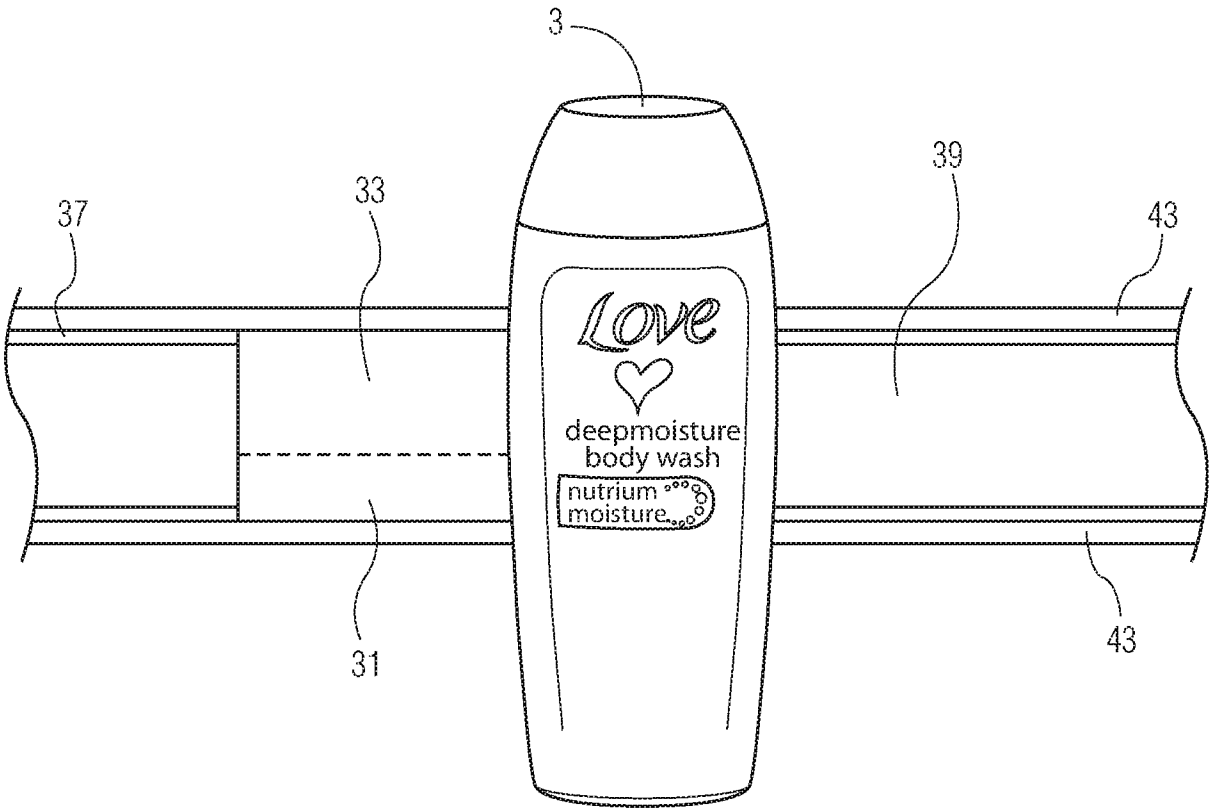
FIG. 14 is front environmental view of the fourth embodiment of the invention in a second disposition.

Referring now to FIG. 14, the panel 31 has been bent 90 degrees forward so that it is in a plane parallel to and rearward of the center panel 3 of the display which faces forward. In this disposition the tab can be mounted over the channel 39 beneath a store shelf.

Figure 15A:
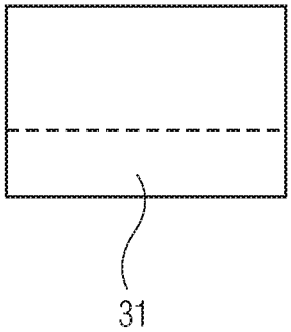
FIG. 15A is a front view of one component of the fourth embodiment of the invention.
Figure 15B:
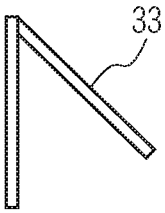
FIG. 15B is a side view of said one component of the fourth embodiment of the invention.

It is common for the channel of a store shelf to have over it a transparent plastic film 37 to which there is adhered a series of unit pricing stickers (not shown). As can be seen in FIGS. 14, 15A, and 15B the panel 31 can be provided at its rear with a downward bent flap 33 which can be tucked behind the plastic strip 37 so that it is entrapped between the plastic strip 37 and the surface of the channel 39. In this way, the display can be suspended from the plastic strip 37. If there is no plastic strip 37 over the channel 39, the rear flap 33 is not needed and the panel 31 can be simply snapped into the channel 39 with its upper and lower edges behind the channel rails 43.

Figure 15C:
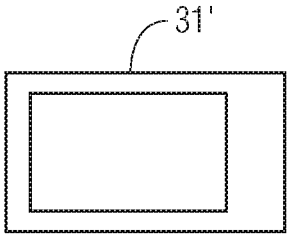
FIG. 15C is a front view of an alternate component of the fourth embodiment of the invention.

For occasions where the panel that is to be inserted between the plastic strip 37 and the channel 39 is over a unit pricing sticker which should not be covered, substitution of a panel 31', shown in FIG. 15C, for the panel 31 solves the problem. Panel 31' is in the form of a frame with an opening through which the unit pricing sticker may be viewed. Panel 31' may be provided with or without a rear flap depending on whether it is to be supported by a film channel cover.

Figure 16:
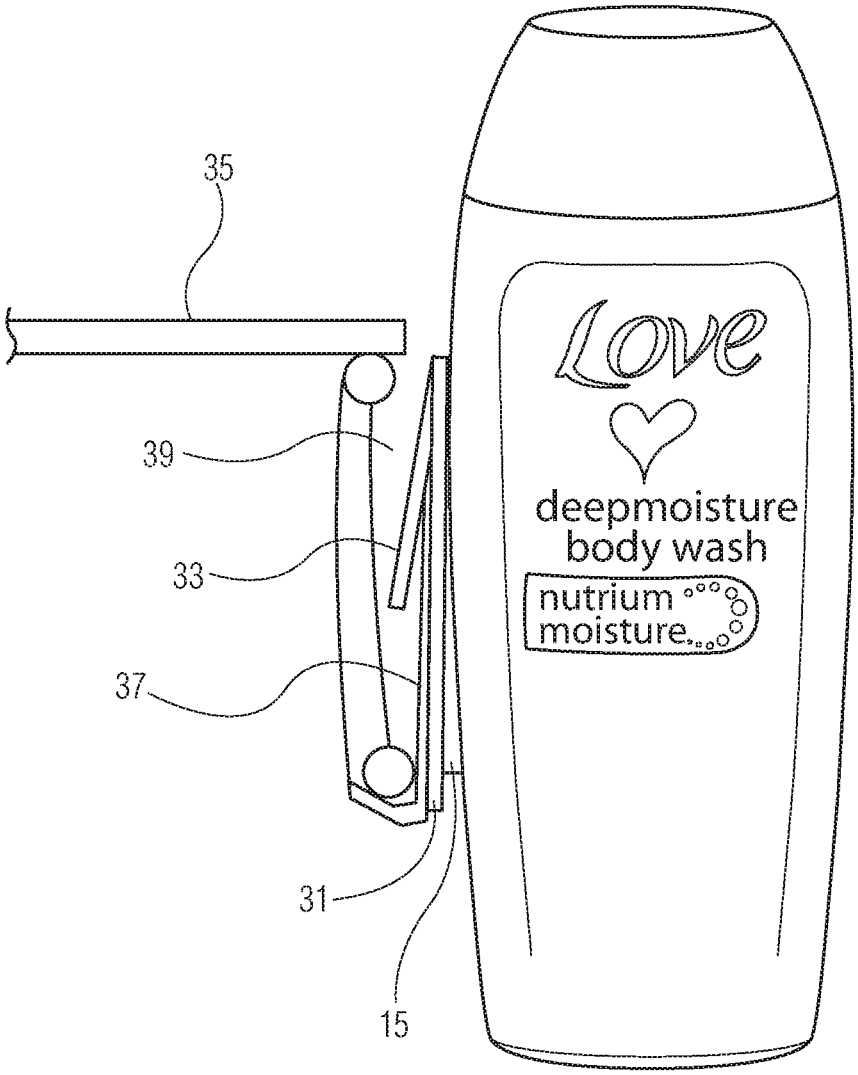
FIG. 16 is a side view of the fourth embodiment of the invention in a third disposition.

It is also possible to fold the panel 31 rearwardly by 90° from its position as shown in FIG. 12 so that it covers the rearmost panel 15. In this case, the panel 31 has the flap 33 extending downwardly and rearwardly so that it may be hooked under the plastic strip 37 as can be seen in FIG. 16. When used this way the panel 31 is blocked from view by the aisle sign or display.

Mounting panel 31 need not be integral with and cut from the sheet material with the display. A separate mounting panel can be fabricated out of clear plastic and provided with an adhesive surface so that it can be affixed to the back panel 15.

Figure 17:
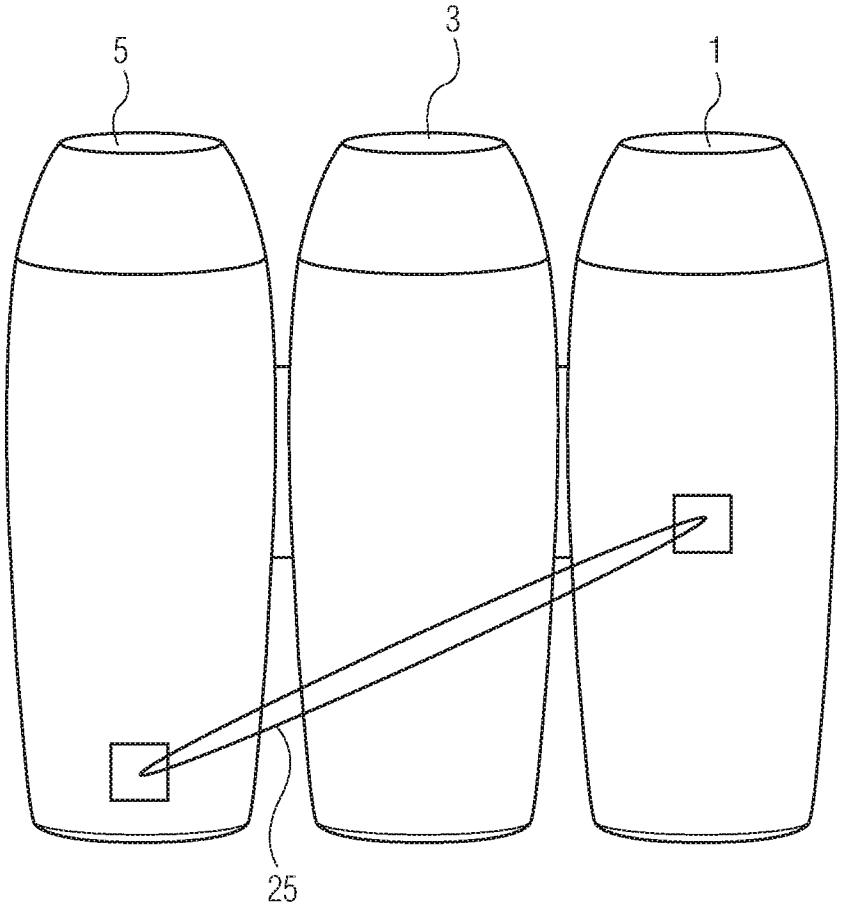
FIG. 17 is a front schematic view of a portion of the invention common to all preferred embodiments of the invention in a disassembled state with an improvement.

Referring now to FIG. 17 there is shown an improvement which can be applied to any of the preferred embodiments of the invention wherein a rubber band 25 or other elastomeric tensioning device, e.g., a coil spring, has its ends affixed to the rear surfaces of image panels 1 and 5. The rubber band or other tensioning device is stretched and tensioned so that when image panel panels 1, 3, and 5 are in a planar position, e.g., when packed for shipping, the tensioning device is stretched and taut. When the planar display is released from the packaging in which it is constrained, the tensioning device pulls the image panel panels 1 and 5 inwardly to automatically erect the three-dimensional shelf talker display. The tension device is selected according to the dimensions of the display so that when the image panels are ninety degrees apart the tensioning device has changed from a taut state to a relaxed state at which it exerts no further pulling force on image panels 1 and 5.

Figure 18:
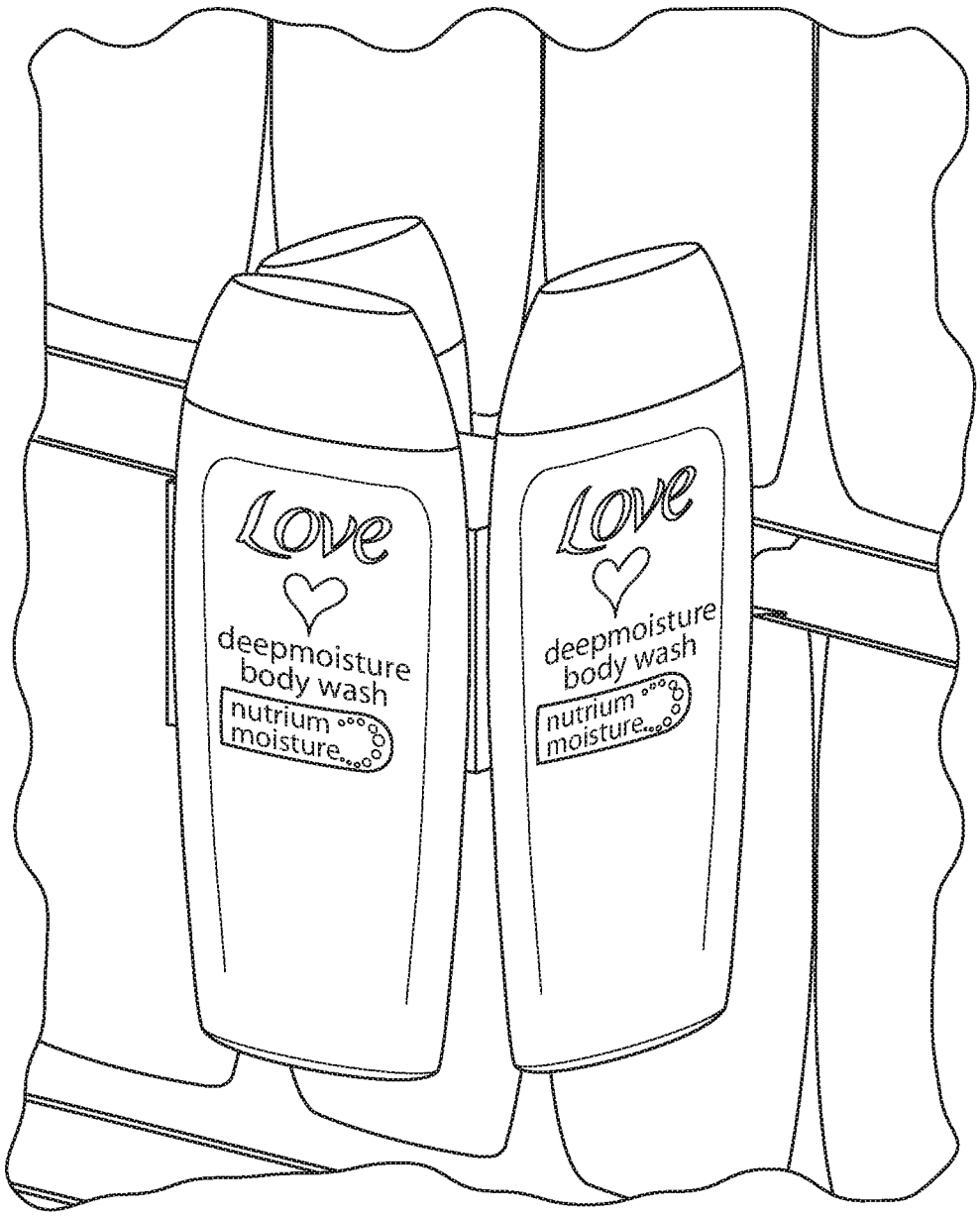
FIG. 18 is a generic environmental perspective view of the invention.

As can be seen in FIG. 18, a shelf talker according to any of the first, second and third embodiments of the invention is mounted in a standard channel below a shelf containing the products illustrated by the shelf talker.

Figure 19:
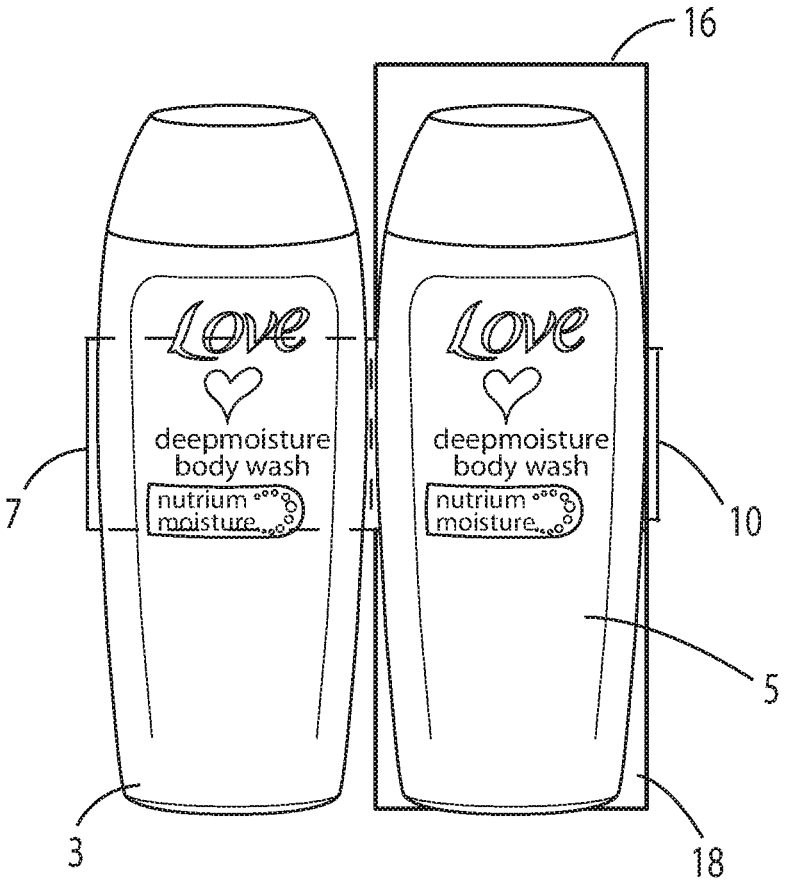
FIG. 19 is a front view of the third embodiment of the invention in an alternative disassembled state.

Referring now to FIG. 19, for convenience, the shelf talker in accordance with the second and third embodiments of the invention can be shipped in assembled and collapsed form with image panel 1 folded along score line 7 to a position behind and hidden by image panel 3 so that panels 1 and 3 are back to back with the image faces of panels 1 and 3 facing outwardly. The extension panel containing panels 15 and 17 can be folded so that panel 15 is back to back with panel 5 and panel 17 is between the rear surface of panel 1 and the rear surface of panel 3, with the adhesive surface of panel 17 affixed to the rear surface of panel 1. In order to erect the aisle sign, the edges of the collapsed sign at score lines 7 and 10 may simply be squeezed toward one another until the sign is in the form of a rectangular parallelepiped. Thereafter the panels 16 and 18, and panel 20 if present, can be folded into position as explained above with respect to FIGS. 4 and 7.

The foregoing is a description of several preferred embodiments of the invention to which variations and modifications may be made without departing from the spirit and scope of the invention. For example, side panels 1 and 5 may be of like maximum width which differs from the maximum width of center panel 3 so that a cross section of the display taken through the display's vertical axis is not square but is still rectangular. That is, the center panel 3 may be wider or narrower than the side panels 1 and 3. Moreover, although the invention has been described as mountable in an environment featuring shelves with channels, the display of the invention can also be affixed to glass freezer doors, pallet displays, aisle displays, and other structures through the use of conventional devices as will be known to those skilled in the art.

What is claimed is:

1. An aisle sign for identifying the location of a product stored on a fixture proximate an aisle, comprising a hollow form in the general shape of a parallelepiped with an open top end and an open bottom end, and having, a left panel with a left panel left edge, a left panel right edge, a left panel free top edge, a left panel free bottom edge, and a left panel face on which there are identifying indicia for said product between said left panel left edge and said left panel right edge, a right panel parallel to, and spaced from, said left panel, said right panel having a right panel left edge, a right panel right edge, a right panel free top edge, a right panel free bottom edge, and a right panel face on which there are identifying indicia for said product between said right panel left edge and said right panel right edge, a center panel joined to said left panel at a first juncture and to said right panel at a second juncture, said center panel having a center panel left edge meeting said left panel right edge at said first juncture, a center panel right edge meeting said right panel left edge at said second juncture, a center panel free top edge, a center panel free bottom edge, and a center panel face on which there are identifying indicia for said product between said center panel left edge and said center panel right edge, a first extension panel joined to one of said left panel and said right panel and connectable to the other of said left panel and said right panel said top free edges of said left panel, said right panel and said center panel forming borders around an open space at said top end of said aisle sign and said bottom free edges of said left panel, said right panel and said center panel forming borders around an open space at said bottom end of said aisle sign.

2. An aisle sign according to claim 1 wherein said first extension panel comprises a fastener panel proximal a free end thereof and distal from said other panel, and an intermediate panel disposed between said other panel and said fastener panel, said first extension panel having a bend between said intermediate panel and said fastener panel, said fastener panel being in a plane parallel to a plane of said other panel, said fastener panel comprising means for affixation to said other panel.

3. An aisle sign according to claim 2 wherein said sign is collapsible to a substantially planar disposition with one of said left panel and said right panel folded back to back with said center panel at one of said first juncture and said second juncture, said first extension panel folded back to back with said other of said left panel and said right panel at said other of said first juncture and said second juncture, said fastener panel being affixed to said one of said left panel and said right panel, said aisle sign being erected to a rectangular parallelepiped upon squeezing of said first juncture and said second juncture toward one another.

4. An aisle sign according to claim 2 wherein said means for affixation to said other panel comprises an adhesive coated onto said fastener panel.

5. An aisle sign according to claim 2 wherein said other of said left panel and said right panel further comprises a second extension, one of said first extension panel and said second extension panel having a barbed end and the other of said first extension panel and said second extension panel having an opening for receiving and capturing said barbed end of said one of said first extension panel and said second extension panel.

6. An aisle sign according to claim 2 further comprising an upper support panel joined to one free edge of said intermediate panel and a lower support panel joined to an opposite freed edge of said intermediate panel, said upper support panel and said lower support panel folded into parallel planes transverse to a plane of said first extension and having respective free ends in engagement with said center panel for providing structural support to said sign.

7. An aisle sign according to claim 1 wherein said other of said left panel and said right panel further comprises a third extension comprising a fastener adapted to be connected to a fixture for mounting said aisle sign on said fixture.

8. An aisle sign according to claim 7 wherein said third extension is coplanar with said other of said left panel and said right panel for being received within a slot of a shelf fixture.

9. An aisle sign according to claim 7 wherein said third extension is bent into a plane parallel to and rearward of said center panel, a top portion of said third extension bent downwardly and rearwardly into a flap insertable behind a transparent strip within the channel of a fixture.

10. An aisle sign according to claim 9 wherein said third extension extends away from said one of said left panel and said right panel and frames an opening through which pricing information in said channel can be viewed.

11. An aisle sign according to claim 1 further comprising an elastic band connected to said left panel and said right panel for erecting said aisle sign from a flat disposition to an erect disposition, said elastic band being expanded under tension when pressure forces said aisle sign into said flat disposition and contracting when said pressure is reduced.

12. An aisle sign according to claim 1 wherein said first junction is spaced from said left panel free top edge, said center panel free top edge, said left panel free bottom edge, and said center panel free bottom edge whereby said left panel free top edge is disconnected from said center panel free top edge and said left panel free bottom edge is disconnected from said center panel free bottom edge, and said second junction is spaced from said right panel free top edge, said center panel free top edge, said right panel free bottom edge, and said center panel free bottom edge whereby said right panel free top edge is disconnected from said center panel free top edge and said right panel free bottom edge is disconnected from said center panel free bottom edge.

13. An aisle sign according to claim 1 wherein said first extension panel is joined to said one of said left panel and said right panel intermediate said free top edge of said one panel and said free bottom edge of said one panel, said first extension panel having a top edge spaced from said free top edge of said one panel and a bottom edge spaced from said free bottom edge of said one panel.

14. An aisle sign according to claim 1 wherein said first extension panel comprises a shelf connector.

15. An aisle sign for identifying the location of a product stored on a fixture proximate an aisle, comprising a hollow form in the general shape of a parallelepiped having, a left panel with a left panel left edge, a left panel right edge and a left panel face on which there are identifying indicia for said product between said left panel left edge and said left panel right edge, a right panel parallel to, and spaced from, said left panel, said right panel having a right panel left edge, a right panel right edge and a right panel face on which there are identifying indicia for said product between said right panel left edge and said right panel right edge, a center panel joined to said left panel at a first juncture and to said right panel at a second juncture, said center panel having a center panel left edge meeting said left panel right edge at said first juncture and a center panel right edge meeting said right panel left edge at said second juncture, and a center panel face on which there are identifying indicia for said product between said center panel left edge and said center panel right edge, a first extension panel joined to one of said left panel and said right panel and connectable to the other of said left panel and said right panel, wherein said first extension panel comprises a fastener panel proximal a free end thereof and distal from said other panel, and an intermediate panel disposed between said other panel and said fastener panel, said first extension panel having a between said intermediate panel and said fastener panel, said fastener panel being in a plane parallel to a plane of said other panel, said fastener panel comprising means for affixation to said other panel, and further comprising an upper support panel joined to one free edge of said intermediate panel and a lower support panel joined to an opposite freed edge of said intermediate panel, said upper support panel and said lower support panel folded into parallel planes transverse to a plane of said first extension and having respective free ends in engagement with said center panel for providing structural support to said sign, said aisle sign further comprising a rear support panel joined to a free end of one of said upper panel and said lower panel, said rear support panel folded into a plane parallel and adjacent to a plane of said center panel, said center panel and said rear support panel being fastened together.

16. An aisle sign according to claim 15 further comprising a channel clip affixed to said rear support panel and adapted to be received within a channel of a fixture for mounting said aisle sign on said fixture.

17. A planar flexible substrate erectable into a three dimensional aisle sign with an open top end and an open bottom end comprising, a left panel with a left panel left edge, a left panel right edge, a left panel free top edge, a left panel free bottom edge, and a left panel face on which there are identifying indicia for said product between said left panel left edge and said left panel right edge, a center panel coplanar with said left panel and having a center panel left edge with a segment joined to a segment of said left panel right edge at a first axis with respect to which said left panel and said center panel are symmetric, said left panel being foldable along said first axis relative to said center panel, said center panel further comprising a center panel right edge, a center panel free top edge, a center panel free bottom edge, and a center panel face on which there are identifying indicia for said product between said center panel left edge and said center panel right edge, a right panel coplanar with said center panel and having a right panel left edge with a segment joined to a segment of said center panel right edge at a second axis with respect to which said center panel and said right panel are symmetric, said right panel being foldable relative to said center panel along said second axis, said right panel further comprising a right panel right edge, a right panel free top edge, a right panel free bottom edge, and a right panel face on which there are identifying indicia for said product between said right panel left edge and said right panel right edge, the width of said left panel at an intersection with said first axis being substantially equal to the width of said right panel at an intersection with said second axis, and a first extension panel coplanar with said center panel, joined to one of said left panel and said right panel, and connectable to the other of said left panel and said right panel, said top free edges of said left panel, said right panel and said center panel forming borders around an open space at said top end of said aisle sign and said bottom free edges of said left panel, said right panel and said center panel forming borders around an open space at said bottom end of said aisle sign.

18. A planar flexible substrate according to claim 17 wherein said first extension panel comprises a fastener panel proximal a free end thereof and distal from said other panel, and an intermediate panel disposed between said other panel and said fastener panel, said first extension panel having a bend between said intermediate panel and said fastener panel, said fastener panel being in a plane parallel to a plane of said other panel, said fastener panel comprising means for affixation to said other panel.

19. A planar flexible substrate according to claim 18 wherein said means for affixation to said other panel comprises an adhesive coated onto said fastener panel.

20. A planar flexible substrate according to claim 18 wherein said other of said left panel and said right panel further comprises a second extension, one of said first extension panel and said second extension panel having a barbed end and the other of said first extension panel and said second extension panel having an opening for receiving and capturing said barbed end of said one of said first extension panel and said second extension panel.

21. A planar flexible substrate according to claim 18 further comprising an upper support panel coplanar with and joined to one free edge of said intermediate panel and a lower support panel coplanar with and joined to an opposite freed edge of said intermediate panel, said upper support panel and said lower support panel being foldable into parallel planes transverse to a plane of said first extension and having respective free ends for engagement with said center panel for providing structural support to said sign once erected.

22. A planar flexible substrate according to claim 17 wherein said other of said left panel and said right panel further comprises a third extension adapted to be connected to a fixture for mounting said aisle sign on said fixture when said aisle sign is erected.

23. A planar flexible substrate according to claim 22 wherein said third extension has a top portion bendable downwardly and rearwardly into a flap insertable behind a transparent strip within a channel of a fixture.

24. A planar flexible substrate according to claim 23 wherein said third extension has an opening forming a window for viewing pricing information in a channel on which said aisle sign is mounted when erected.

25. A planar flexible substrate according to claim 17 further comprising an elastic band connected to said left panel and said right panel for erecting said aisle sign from a flat disposition of said planar substrate to an erect disposition, said elastic band being expanded under tension when pressure forces said aisle sign into said flat disposition and contracting when said pressure is reduced.

26. A planar flexible substrate according to claim 17 wherein said left panel has a maximum width equal to the maximum width of said right panel and said parallelepiped, when erected, is a rectangular parallelepiped having a rectangular cross section when taken through a vertical axis thereof.

27. A planar flexible substrate according to claim 26 wherein said center panel has a maximum width equal to the maximum widths of said left panel and said right panel and said parallelepiped, when erected, has a square cross section when taken through a vertical axis thereof.

28. A planar flexible substrate erectable into a three dimensional aisle sign comprising a left panel with a left panel left edge, a left panel right edge and a left panel face on which there are identifying indicia for said product between said left panel left edge and said left panel right edge, a center panel coplanar with said left panel and having a center panel left edge with a segment joined to a segment of said left panel right edge at a first axis with respect to which said left panel and said center panel are symmetric, said left panel being foldable along said first axis relative to said center panel, said center panel further comprising a center panel right edge, and a center panel face on which there are identifying indicia for said product between said center panel left edge and said center panel right edge, a right panel coplanar with said center panel and having a right panel left edge with a segment joined to a segment of said center panel right edge at a second axis with respect to which said center panel and said right panel are symmetric, said right panel being foldable relative to said center panel along said second axis, said right panel further comprising a right panel right edge, and a right panel face or which there are identifying indicia for said product between said right panel left edge and said right panel right edge, the width of said left panel at an intersection with said first axis being substantially equal to the width of said right panel at an intersection with said second axis, and a first extension panel coplanar with said center panel, joined to one of said left panel and said right panel, and connectable to the other of said left panel and said right panel, wherein said first extension panel comprises a fastener panel proximal a free end thereof and distal from said other panel, and an intermediate panel disposed between said other panel and said fastener panel, said first extension panel having a bend between said intermediate panel and said fastener panel, said fastener panel being in a plane parallel to a plane of said other panel, said fastener panel comprising means for affixation to said other panel, an upper support panel coplanar with and joined to one free edge of said intermediate panel and a lower support panel coplanar with and joined to an opposite freed edge of said intermediate panel, said upper support panel and said lower support panel being foldable into parallel planes transverse to a plane of said first extension and having respective free ends for engagement with said center panel for providing structural support to said sign once erected, and a rear support panel joined to a free end of one of said upper panel and said lower panel, said rear support panel foldable into a plane parallel and adjacent to a plane of said center panel, and means for fastening on at least one of said center panel and said rear support panel for fastening said center panel and said rear support panel together.

* * * * *